US011708832B2

(12) United States Patent
Akhtar et al.

(10) Patent No.: US 11,708,832 B2
(45) Date of Patent: Jul. 25, 2023

(54) COOLED DRY VACUUM SCREW PUMP

(71) Applicant: FRUVAC LTD., Stoney Creek (CA)

(72) Inventors: Khurram Akhtar, Mississauga (CA); Christopher White, Hamilton (CA)

( * ) Notice: Subject to any disclaimer, the term of this patent is extended or adjusted under 35 U.S.C. 154(b) by 0 days.

(21) Appl. No.: 17/622,041

(22) PCT Filed: Aug. 2, 2019

(86) PCT No.: PCT/CA2019/051066
§ 371 (c)(1),
(2) Date: Dec. 22, 2021

(87) PCT Pub. No.: WO2021/022352
PCT Pub. Date: Feb. 11, 2021

(65) Prior Publication Data

US 2022/0268279 A1 Aug. 25, 2022

Related U.S. Application Data

(63) Continuation-in-part of application No. PCT/CA2019/051066, filed on Aug. 2, 2019.

(51) Int. Cl.
*F04C 18/06* (2006.01)
*F04C 18/16* (2006.01)
(Continued)

(52) U.S. Cl.
CPC ..... *F04C 18/16* (2013.01); *F04C 25/02* (2013.01); *F04C 28/24* (2013.01); *F04C 29/042* (2013.01);
(Continued)

(58) Field of Classification Search
CPC ..... F04C 18/16; F04C 18/06; F04C 25/02; F04C 28/24; F04C 28/10; F04C 29/042
See application file for complete search history.

(56) References Cited

U.S. PATENT DOCUMENTS

2009/0311119 A1* 12/2009 Holden ..... F04C 28/265 418/201.1
2012/0230858 A1 9/2012 Yuya et al.
(Continued)

FOREIGN PATENT DOCUMENTS

DE 202005021169 U1 * 6/2007 ..... F04C 18/086
DE 102014110073 A1 * 1/2016 ..... F04C 25/02
(Continued)

OTHER PUBLICATIONS

English translation of SE-422350 by PE2E Jul. 14, 2022.*
(Continued)

*Primary Examiner* — Deming Wan
(74) *Attorney, Agent, or Firm* — Amundsen Davis, LLC; Joseph S. Heino; Erin E. Kaprelian

(57) ABSTRACT

The present invention relates to rotary screw positive displacement machines used as a vacuum pump wherein additional intake air is provided allowing cooling to the invention which permits extended operation at extreme vacuum pressure. The rotary screw nature of the vacuum pump allows operation without additional lubrication with the additional intake air ensuring that thermal expansion will not disrupt the tight tolerances of the invention. The invention allows simultaneous operation as a vacuum pump and air compressor.

12 Claims, 8 Drawing Sheets

(51) Int. Cl.

| | |
|---|---|
| ***F04C 29/00*** | (2006.01) |
| ***F04C 29/04*** | (2006.01) |
| ***F04C 25/02*** | (2006.01) |
| ***F04C 28/24*** | (2006.01) |

(52) U.S. Cl.
CPC ..... *F04C 2220/12* (2013.01); *F04C 2240/20* (2013.01); *F04C 2240/30* (2013.01)

(56) References Cited

U.S. PATENT DOCUMENTS

| | | | | |
|---|---|---|---|---|
| 2015/0337716 | A1* | 11/2015 | Ouwenga | F02B 33/40 417/364 |
| 2016/0208801 | A1* | 7/2016 | Hauser | F04C 18/084 |

FOREIGN PATENT DOCUMENTS

| | | | | | |
|---|---|---|---|---|---|
| JP | 2014190477 | A | * | 10/2014 | |
| SE | 422350 | B | * | 4/1978 | F04C 18/16 |
| WO | WO-0157401 | A1 | * | 8/2001 | F04C 18/16 |
| WO | 2006061317 | A1 | | 6/2006 | |

OTHER PUBLICATIONS

English translation of WO-0157401 by PE2E Oct. 20, 2022.*
English translation of JP 2014190477 by PE2E Oct. 20, 2022.*
English translation of DE 102014110073 by PE2E Oct. 20, 2022.*
English translation of DE 202005021169 by PE2E Jan. 19, 2022.*
Search Report & Written Opinion for PCT Patent Application No. PCT/CA2019/051066, "Cooled Dry Vacuum Screw Pump" dated Apr. 23, 2020, 8 pages filed herewith.

* cited by examiner

Figure 10

Simulated Device Performance without air injection

SUCTION PRESSURE .10 BAR RESERVOIR PRESSURE 1.00 BAR

| W m/s | rpm | Q $m^3$/min | $\eta_v$ | P kW | kW/ $m^3$/min | $\eta_a$ | T °C | m kg/s |
|---|---|---|---|---|---|---|---|---|
| 35.300 | 5504.202 | 4.616 | .433 | 9.544 | 2.068 | .263 | 660.409 | .009 |
| 38.570 | 6014.080 | 5.333 | .458 | 10.394 | 1.949 | .279 | 668.836 | .011 |
| 41.840 | 6523.958 | 6.178 | .489 | 11.241 | 1.820 | .298 | 654.662 | .012 |
| 45.110 | 7033.836 | 7.053 | .517 | 12.087 | 1.714 | .317 | 636.598 | .014 |
| 48.380 | 7543.714 | 7.937 | .543 | 12.934 | 1.630 | .333 | 620.265 | .016 |
| 51.650 | 8053.592 | 8.832 | .566 | 13.785 | 1.561 | .348 | 605.760 | .017 |
| 54.920 | 8563.470 | 9.726 | .586 | 14.637 | 1.505 | .361 | 593.553 | .019 |
| 58.190 | 9073.348 | 10.620 | .604 | 15.493 | 1.459 | .372 | 583.181 | .021 |
| 61.460 | 9583.226 | 11.511 | .620 | 16.352 | 1.421 | .382 | 574.320 | .023 |

Figure 11

Simulated Device Performance with air injection

SUCTION PRESSURE .10 BAR RESERVOIR PRESSURE 1.00 BAR

| W m/s | rpm | Q $m^3$/min | $\eta_v$ | P kW | kW/ $m^3$/min | $\eta_a$ | T °C | m kg/s |
|---|---|---|---|---|---|---|---|---|
| 35.300 | 5504.202 | 5.412 | .507 | 14.465 | 2.673 | .203 | 208.338 | .011 |
| 38.570 | 6014.080 | 6.333 | .543 | 15.702 | 2.479 | .219 | 207.330 | .013 |
| 41.840 | 6523.958 | 7.270 | .575 | 16.926 | 2.328 | .233 | 206.294 | .014 |
| 45.110 | 7033.836 | 8.219 | .603 | 18.140 | 2.207 | .246 | 205.290 | .016 |
| 48.380 | 7543.714 | 9.179 | .628 | 19.345 | 2.107 | .258 | 204.343 | .018 |
| 51.650 | 8053.592 | 10.146 | .650 | 20.542 | 2.025 | .268 | 203.468 | .020 |
| 54.920 | 8563.470 | 11.112 | .670 | 21.717 | 1.954 | .278 | 202.952 | .022 |
| 58.190 | 9073.348 | 12.072 | .687 | 22.865 | 1.894 | .287 | 202.861 | .024 |
| 61.460 | 9583.226 | 13.030 | .702 | 23.997 | 1.842 | .295 | 203.032 | .026 |

COOLED DRY VACUUM SCREW PUMP

FIELD OF THE INVENTION

The present invention relates to rotary screw positive displacement machines which serve as a vacuum pump wherein additional intake air is provided allowing lower temperature operation. The machines do not require lubrication and can also be used as compressors at the same time as serving as a vacuum pump.

BACKGROUND OF THE INVENTION

Vacuum is used in many industrial settings. Some of these settings require mobility. Mobile means of producing vacuum must be small, lightweight, maintenance free and not produce an inordinate amount of heat.

Many different types of machines are known as means of creating vacuum. Of these, rotary screw positive displacement machines have many advantages useful for the mobile production of vacuum.

A rotary screw positive displacement machine comprises a casing having two intersecting bores the axes of which are coplanar and parallel to each other, and male and female screw-like rotors mounted for rotation about their axes each of which coincides with the casing bore axes.

Such machines have helical lobes on the male rotor which mesh with helical grooves between the lobes of the female rotor. As seen in cross section, the male rotor has a set of lobes which project outwardly from its pitch circle. As seen in cross section, the female rotor has a set of grooves extending inwardly of its pitch circle and corresponding to the lobes of the male rotor. The number of lobes and grooves of the male rotor may be different to the number of lobes and grooves of the female rotor.

At times, given the cross-sectional appearance of the lobes on the female rotor, the female rotor may be referred to as the 'gate' rotor and the male rotor may be referred to as the 'main' rotor.

Examples of rotary screw machines, which may be used as compressors or expanders, are disclosed in U.S. Pat. No. 3,423,017, GB2092676, and GB2484718. Rotary screw positive displacement machines are a mature technology resulting in a machine which is compact yet highly efficient.

GB2092676 describes a rotary screw positive displacement machine used as a compressor. In this device the intake air or liquid is spread over part of the length of the screws. The machine is different than the object of the present invention as it includes provision for the addition of oil to the rotors.

GB2484718 describes a rotary screw positive displacement machine used as an expander with a gas such as steam. This machine is different than the object of the present invention in that the rotors are driven by the gas flow rather than requiring power to be applied to the rotors. Rotary positive displacement machines being used as an expander provide energy from the rotors; when used as a compressor, energy must be supplied to the rotors.

Application GB2537635A describes a rotary screw positive displacement machine used as a vacuum pump which is similar to the present invention in that it does not use lubrication. However, this machine is different from the present invention in the significant difference in the style and shape of both the male and female rotor lobes.

When a rotary screw positive displacement machine is used as an expander, which is unlike the present invention, the rotors are driven by the expansion of the gas introduced to the machine. When the machine is used as a compressor, which is like the present invention, the rotors must be driven by external means to achieve compression of the gas.

When a machine must be driven by external means, external driving force is normally applied to one of the rotors with the other rotor being driven by appropriate gearing.

With a different number of lobes on the two rotors, the gearing must accommodate the need to drive the rotors having a different number of lobes at different speeds in order to ensure their correct meshing.

An alternate disposition for the driving of the rotors is to drive both rotors with appropriate gearing connected to the external driving force.

If both rotors have the same number of lobes, for example six (6) lobes on each of the male and female rotors, the gearing will drive the rotors in a 1:1 ratio. If there are three (3) lobes on the male rotor and six (6) lobes on the female rotor, a gear ratio of 2:1 will be required to drive the male rotor twice as fast as the female rotor. Other lobe combinations will result in different gearing requirements such as 1.67:1 for 3/5 lobes (where the first number 3 represents the number of lobes on the male rotor and the second number 5 represents the number of lobes on the female rotor) and 1.5:1 for 4/6 lobes.

An operating challenge with dual screw positive displacement machines used as a compressor is the heating that occurs from the compression of air within the machine at the rotors.

In practice, dual screw positive displacement machines used as a compressor must usually use some type of cooling. For example, applications SE9603424A and FR1092214A and U.S. Pat. No. 2,627,161 all describe the cooling of the casing and the rotors by the use of cooling fluid channels which is unlike the present invention.

U.S. Pat. No. 2,627,161 also achieves cooling by the use of air flows within the invention. However, unlike the present invention, there is no point at which air is introduced to the screws at an intermediate location between inlet and outlet.

In U.S. Pat. No. 5,924,855 cooling of the rotors of a spindle pump is, in part, achieved by what that patent refers to as the 'preadmission' of air. The term 'preadmission' is misleading as it suggests the admission of air before the normal air inlet. In that patent, air is admitted after the normal air inlet which would suggest a 'postadmission'. Spindle pumps are unlike the present invention. Spindle pumps operate by moving the gas from the inlet to outlet ports with no internal compression. Compression is only achieved at the outlet port. Accordingly, it is not obvious that the 'preadmission' of air used in a spindle pump would be effective in a dual screw positive displacement machine.

As described in section 5.3.4.6 of Jorisch, Wolfgang, *Vacuum Technology in the Chemical Industry* (Wiley, 2015, ISBN: 9783527653928), there is a type of vacuum pump known as a Roots vacuum pump which allows pre-admission cooling. It operates by cooling outlet gas and then re-introducing the cooled gas into the compression chamber. However, this is unique to the specific type of pump described and it would not be obvious to someone skilled in the art to apply it to rotary screw positive displacement engines.

WO2005033519 describes the use of water to cool a dual screw positive displacement machine. Means are also suggested therein for the recovery of the water. The use of water to cool a device is well known and dissimilar to the present invention.

SUMMARY OF THE INVENTION

It is an object of the present invention to provide a dual screw positive displacement machine to generate vacuum without the need for lubricating oil.

It is a second object of the present invention to demonstrate that the injection of a gas after the initial inlet may be achieved in a dual screw positive displacement machine to achieve lower operating temperatures of the machine. Lower operating temperatures reduce the amount of thermal expansion in the invention which, in turn, allow tight tolerances to be maintained without lubricating oil.

It is a third object of the present invention to provide a dual screw positive displacement machine to provide a vacuum while at the same time being able to provide a source of usable compressed air which is suitable for mobile application.

An efficient dual screw positive displacement machine must admit the highest possible gas flow rates for a given rotor size and speed. This means that the rotor cross-sectional area for gas flow must be as large as possible. In addition, the maximum delivery per unit size or weight of the machine must be accompanied by minimum power utilization.

The rotor configuration and shape, as well as the compressor size and built-in volume ratio need to be simultaneously optimized to give the best compressor speed and the largest gas flow for the minimum compressor weight and the best compressor efficiency.

Optimization also takes into account that the machine will be operated without lubrication. Therefore, unavoidable losses such as gas leakage and flow losses must be minimized. Since screw compressor leakage flow is dependent on the clearance gap area and pressure difference across it and the volumetric efficiency is a function of the ratio of the leakage flow to the bulk flow through the compressor, the influence of leakage may be more than compensated by greater bulk gas flow rates. Optimization also must occur to ensure that the efficiency of the energy interchange between the gas and the machine is a maximum.

The required compressor delivery rate must be obtained while simultaneously optimizing the rotor size and speed to minimize the compressor weight while maximizing its efficiency, as well as the inlet temperature and position A dual screw positive displacement machine according to the present invention is characterized in that the profiles of at least those parts of the lobes projecting outwardly of the pitch circle of the male rotor and the profiles of at least the grooves extending inwardly of the pitch circle of the female rotor are generated by the same rack formation. The lobes are curved in one direction about the axis of the male rotor. The grooves are curved in the opposite direction about the axis of the female rotor. The portion of the rack which generates the higher-pressure flanks of the rotors being generated by rotor conjugate action between the rotors.

Advantageously, a portion of the rack, preferably that portion which forms the higher-pressure flanks of the rotor lobes, has the shape of a cycloid. Alternatively, this portion may be shaped as a generalized parabola.

Normally, the bottoms of the grooves of the male rotor lie inwardly of the pitch circle as "dedendum" portions and the tips of the lobes of the female rotor extend outwardly of its pitch circle as "addendum" portions. Preferably, these dedendum and addendum portions are also generated by the rack formation.

Rotor configuration is determined by the number of lobes in the main (male) and gate (female) rotors, for example, a 3/6 configuration means 3 lobes in the main and 6 lobes in the gate rotor. The configuration determines the rotor displacement, inter-lobe sealing line, rotor rigidity and size of the discharge port. Thus, the rotor configuration greatly influences the compressor size and performance.

The choice of rotor configuration is optimized between the rotor tightness, small blow-hole area, large displacement, and short sealing lines, small confined volumes, involute rotor contact and proper gate rotor torque distribution together with high rotor mechanical rigidity. The rotors considered in the present invention were obtained automatically from the computer code simply by specifying the number of lobes in the male and female rotors, and the lobe curves in a general form. The calculation was performed by the use of design software described in Stosic N, Smith I. K. and Kovacevic A, 2005, *Screw Compressors: Mathematical Modelling and Performance Calculation*, (Springer Verlag, Berlin, ISBN 978-3-540-24275-8).

Generally, rotors with a smaller number of lobes are worse in a mechanical sense, that is that their moment of inertia is lower than that of the rotors with higher number of lobes for the same displacement, therefore the rotor deflection will be more. However, this is not important for low pressure rotors, because the pressure forces are low. Their ratio of displacement to sealing line length is better, which is a good prerequisite for better thermodynamic performance.

The 3/5 and the more traditional 4/6 lobe configurations are suitable for low pressure lubrication-free compressors. The rotor configurations with a surplus of more than one lobe in the female rotor, for example 4/6 compared with 3/5 rotors do not have mechanical advantages because despite the higher moment of inertia of their female rotor, they have a larger surface area of the female rotor exposed to high pressure and the rotor deflection is the same. The 3/6 rotor configuration is fully justified if a higher gear ratio is required, as when a gear box is not expected to be employed.

The advantage of a 3/6 rotor configuration, if compared with the 3/5 and 4/6 configurations, is in its gear ratio of 2 compared with 1.67 for the 3/5 and 1.5 of the 4/6 rotors. That gives the opportunity to these rotors, if driven through the female rotor to rotate almost 20% slower than the 3/5 and 33% slower than 4/6 rotors, of the same male rotor size, to achieve the same flow.

The cross-section surface area of the 3/6 rotors is larger than that of the 3/5 and 4/6 rotors for the same rotor size and, moreover, the sealing line length in relation to the rotor cross section surface is more favourable for the 3/6 and 3/5 rotors than for the 4/6 rotors. Based on the foregoing, the present invention is preferably disposed with 3/5 rotors which will allow lubrication free operation.

Screw compressors for delivery of dry air operate at modest pressure ratios of up to 1:3 to ensure that discharge gas temperatures remain in the range of 180 to 200 degrees Celsius. The larger pressure ratios, especially under conditions of high internal leakage will lead to higher levels of discharge temperature. If suction pressure is reduced by any reason and the discharge pressure is maintained, the pressure ratio will increase and as a result, the discharge temperature will increase further.

Excessive discharge temperatures are avoided in order to avoid the use of special handling of the outlet gas. In addition, lower discharge temperatures will allow the discharge gas to be used as a source of compressed gas for purposes related to the use of the vacuum.

It will be appreciated that other well-known techniques such as the use of heat-dissipation fins attached to the casing can be used to reduce the operating temperatures of the invention.

When operated as vacuum pumps, the suction pressure of screw compressors is sub-atmospheric, while the discharge pressure is maintained close to atmospheric pressure. As a result, the pressure ratio is increased and, in some cases, may become very large.

Since the compression process of a screw compressor under vacuum condition happens in sub-atmospheric pressures when the discharge pressure is atmospheric, it is possible to naturally inject cold atmospheric air under atmospheric conditions to mix with the hot compressed air. This results in a reduction of the compressor discharge temperature especially if mass of the injected air is larger and even far larger than the mass of the compressed air.

The size and position of the injection port can be determined conveniently to coincide with the compression pressure which will ensure proper component mass mixture ratio between the hot compressed and cold atmospheric air. The process is automatic, because a lower suction pressure will require more cold atmospheric air to be injected, which will, in turn, be conveniently done at lower compression pressure at the same screw compressor geometrical point.

Another parameter, a part of the pressure difference, which determines the cold air flow is the injection port area surface for the air injection. Since the area of this port is relatively large, preferably the shape of the injection port follows the rotor helix in order to prevent intensive internal recirculation of the compressed air in the injection port gaps.

The effectiveness of the use of the injection port can be evaluated by collecting data of the machine while the port is blocked and collecting data while the port is open.

In computer simulations of the invention, temperature differences between operation with the injection port open and closed exceeds 350 degrees Celsius. In addition, output temperatures of the invention with the injection port open are generally below 225 degrees Celsius.

In actual operation of the invention, output temperatures of below 150 degrees Celsius have been achieved while operating the invention with the injection port open at 1370 RPM with 22 inches of mercury Vacuum (558.80 mm mmHg/Torr or 0.74 bar) for more than 45 minutes with an ambient air temperature of 84 degrees Fahrenheit.

In actual use, gas flows within the invention will be directed with suitable ducting or elbows and controlled with valves.

The use of suitable ducting, elbows and valves will allow vacuum and compressed air to be available at the same time for use.

BRIEF DESCRIPTION OF THE DRAWINGS

The invention will now be described by way of example with reference to the drawings, in which:

FIG. 10 is a table of simulation results with the injection port closed.

FIG. 11 is a table of simulation results with the injection port open.

DETAILED DESCRIPTION OF THE INVENTION

Figure 1:
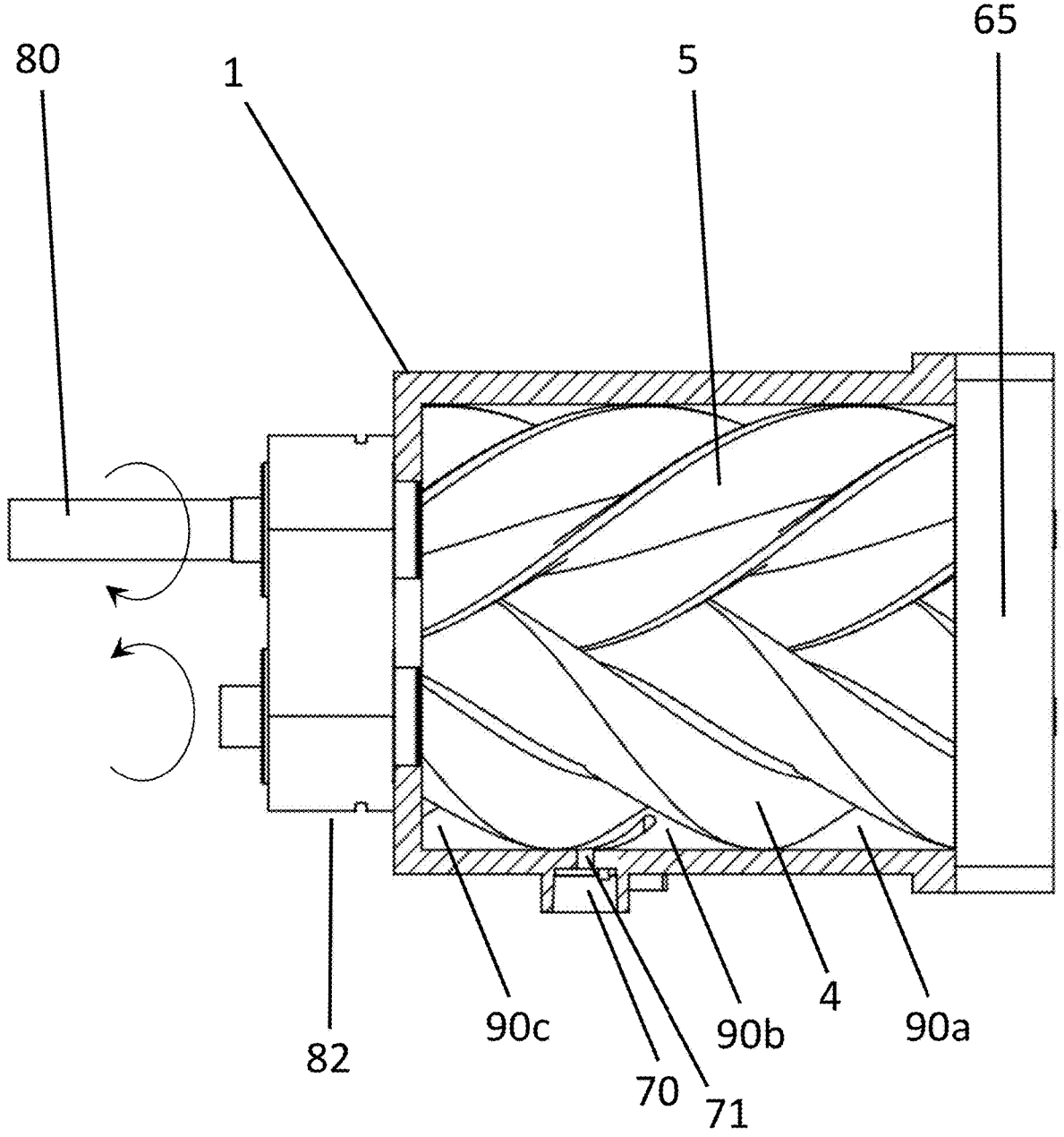
FIG. 1 is a simplified cut-away view of the invention from the bottom.

In the following detailed description, only certain exemplary embodiments have been shown and described, simply by way of illustration. As those skilled in the art would realize, the described embodiments may be modified in various different ways, all without departing from the spirit or scope of this description.

The same reference numerals indicate the same members in all of the drawings.

FIG. 1 shows a simplified cross-sectional view of the invention from the bottom. The figure shows the casing 1, the air inlet end of the casing 65, and the air injection port 70 and the actual air injection opening in the casing 71. Not shown is the air outlet port which is on the opposite side of the casing. Rotational force is applied to the shaft 80 which is directly connected to the gate rotor 5 and which also drives the main rotor 4 through the gearbox 82, in a direction opposite to that of the gate rotor 5 as indicated in the drawing. The compression of the air between the rotors 4 and 5 causes air to be drawn in at the air inlet end of the casing 65 creating a vacuum.

The lobes of the main rotor 4, the interaction of the lobes of the gate rotor 5 with the grooves of the main rotor 4 and the wall of the casing 1 create a number of moving chambers of air 90. Three such moving chambers of air are shown as 90*a*, 90*b* and 90*c*. Similar unlabeled moving chambers of air are created on the opposite side of the casing.

As the main rotor 4 turns, the moving chamber of air 90*b* uncovers the air injection port opening 71 in the air injection port 70. Because the air in chamber 90*b* is under a vacuum, air at atmospheric pressure and temperature enters into the said air chamber in turn causing the air in the system to be cooled.

Figure 2:
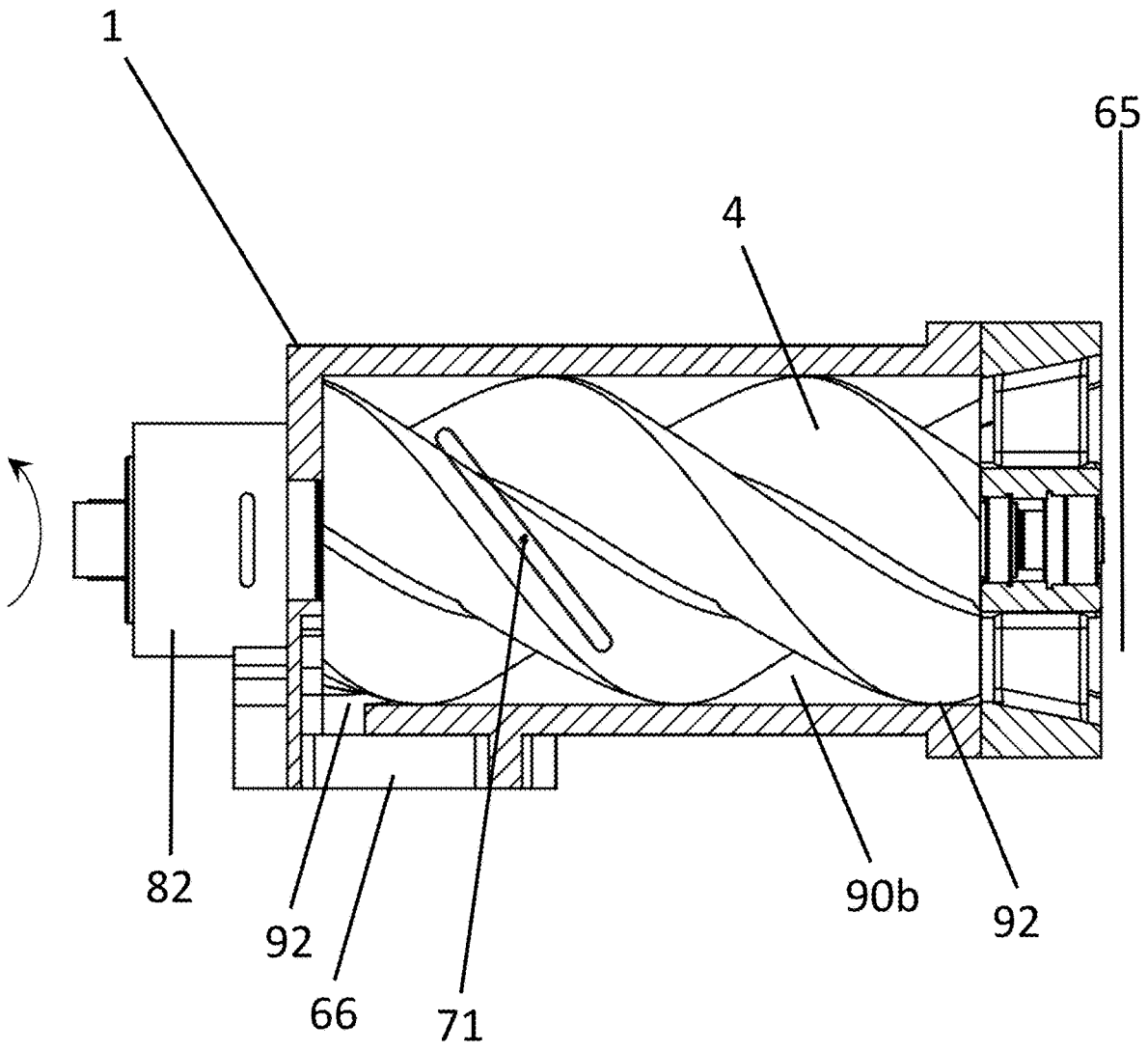
FIG. 2 is a simplified cut-away view of the invention from the side which shows the location of the air injection port.

FIG. 2 shows a simplified cut-away view of the invention from the side including the air injection port opening 71. The main rotor 4 is adjacent to the air injection port opening 71 in the casing 1. The main rotor 4 is driven through the gearbox 82 in the direction shown on the drawing.

The driving of the main rotor 4 causes a vacuum to be created at the air inlet end of the casing 65 causing air to enter the device and create the previously described moving chambers of air. The moving chambers of air are under a vacuum. Accordingly, when the moving chamber of air 90*b* is cut off from outside air from the air inlet end of the casing 65 by the interaction of the rotor 4 and the casing 1 at the point labelled 92, and the air injection opening 71 is uncovered, air at atmospheric pressure and temperature enters into the said air chamber in turn causing the air in the system to be cooled.

Through the operation of the rotors, when the moving chambers of air reach the outlet opening 92, compressed air is exhausted through the outlet port 66.

Figure 3:
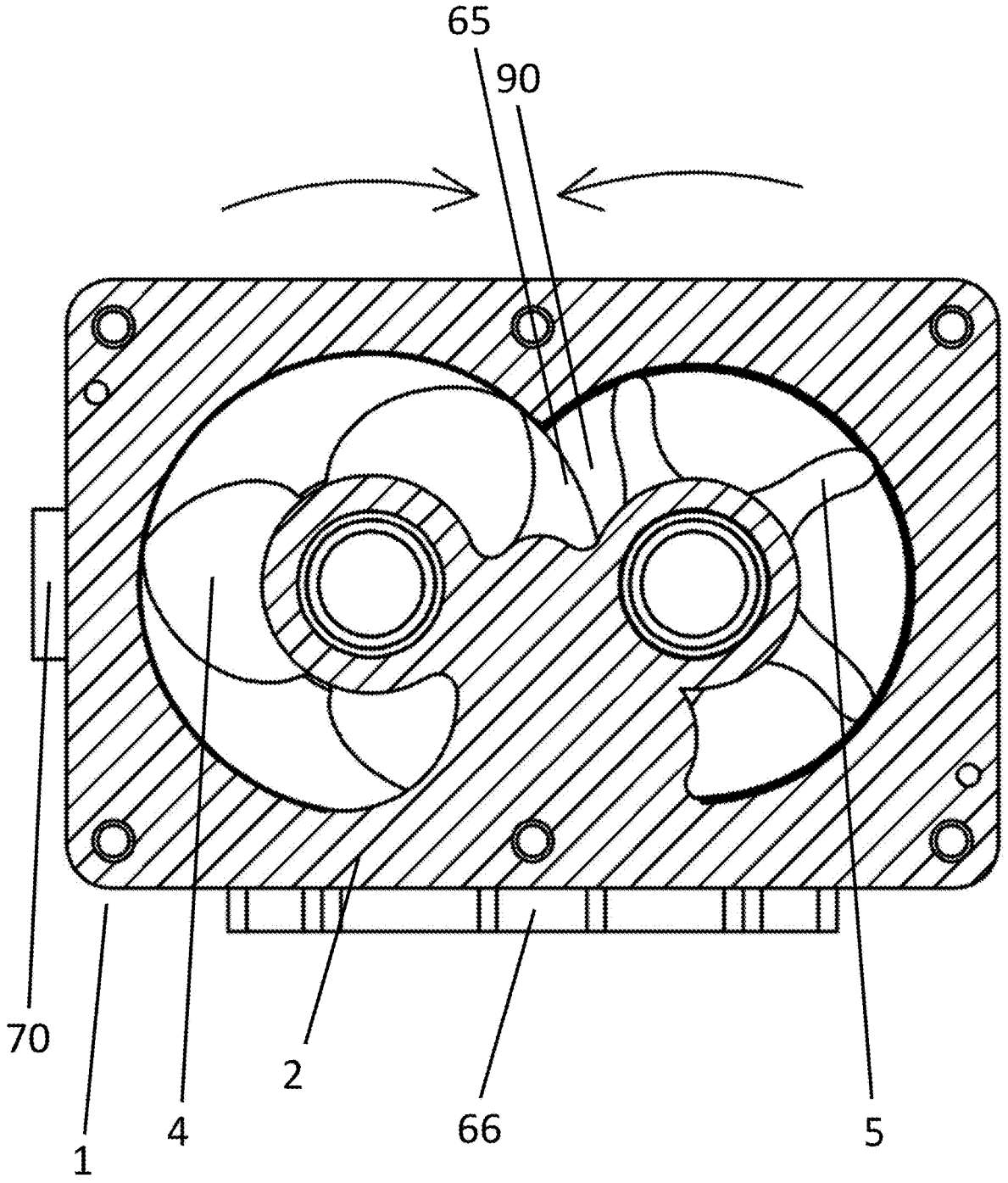
FIG. 3 is a simplified view of the invention seem from the air inlet.

FIG. 3 is a simplified view of the invention seem from the air inlet 65. The main rotor 4 and the gate rotor 5 are seen behind the end plate 2 which is in turn attached to the casing 1. The outlet port 66 and the air injection port 70 are also seen.

As the rotors 4 and 5 rotate in the direction indicated in the drawing, the lobes of the rotors 4 and 5 begin to define one of the moving chambers of air 90. The end plate 2 acts as a wall of the moving chamber of air 90. The movement of air created by the rotation of the rotors creates a vacuum. The moving chamber of air 90 is initially compressed by the action of the rotors causing the air to be heated. The moving chamber of air 90 continues the length of the rotors until cooling air at atmospheric pressure is introduced at the air injection port 70. The air is finally exhausted at the air outlet 66.

Figure 4:
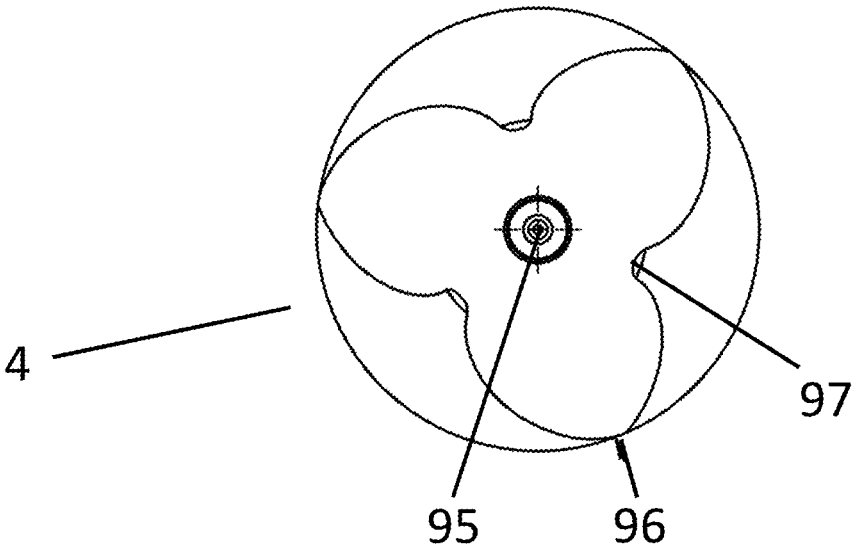
FIG. 4 is a cross-section of a preferred embodiment of the male or main rotor of the invention seen from the air outlet end.

FIG. 4 shows a cross-section of a preferred embodiment of the main or male rotor 4 of the invention seen from the air outlet end of the rotor. The rotor comprises three (3) lobes about a central axis 95. Each lobe has a leading edge 96 and a groove 97. The actual shape of the rotor lobes is obtained as described above.

Figure 5:
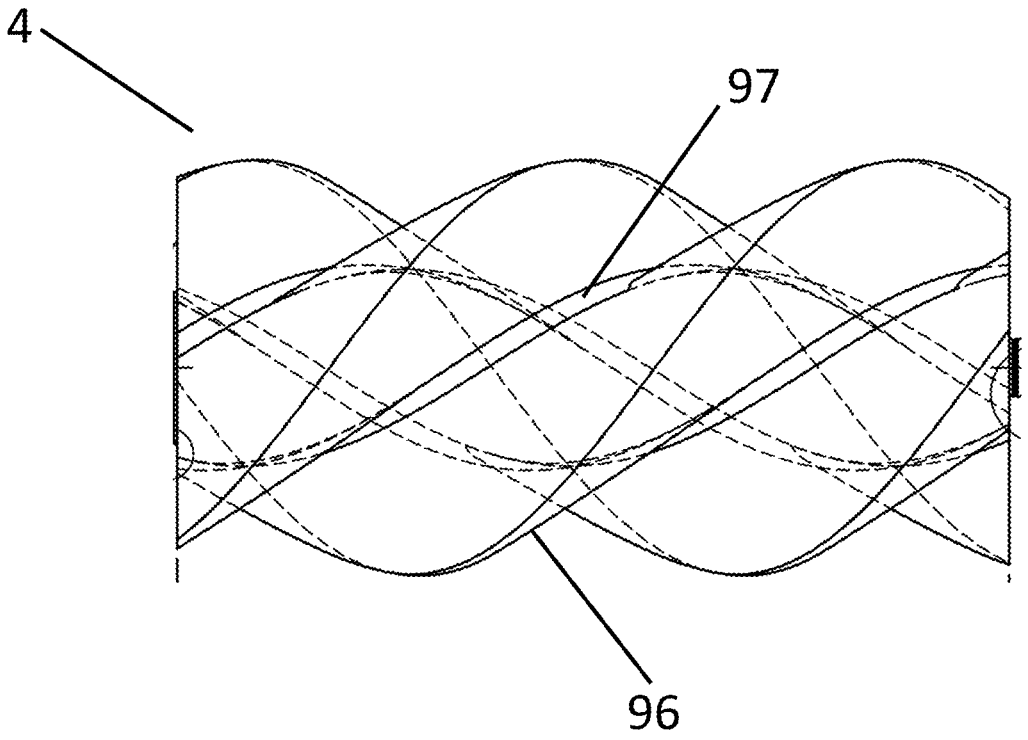
FIG. 5 is a hidden-line drawing of a side view of a preferred embodiment of the male or main rotor of the invention.

FIG. 5 shows a hidden-line drawing of a side view of a preferred embodiment of the main or male rotor 4 of the invention. The drawing shows a leading edge 96 and a groove 97 in a right-handed thread.

Figure 6:
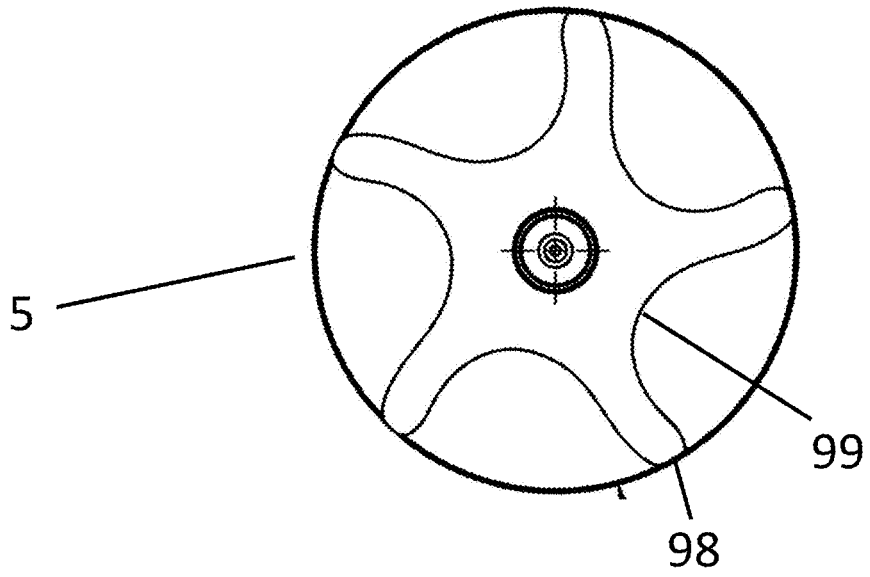
FIG. 6 is a cross-section of a preferred embodiment of the female or gate rotor of the invention seen from the air outlet end.

FIG. 6 shows a cross-section of a preferred embodiment of the gate or female rotor of the invention seen from the air outlet end of the rotor. The rotor comprises five (5) lobes about a central axis with each lobe having a leading edge 98 and a groove 99. The actual shape of the rotor lobes is obtained as described above.

Figure 7:
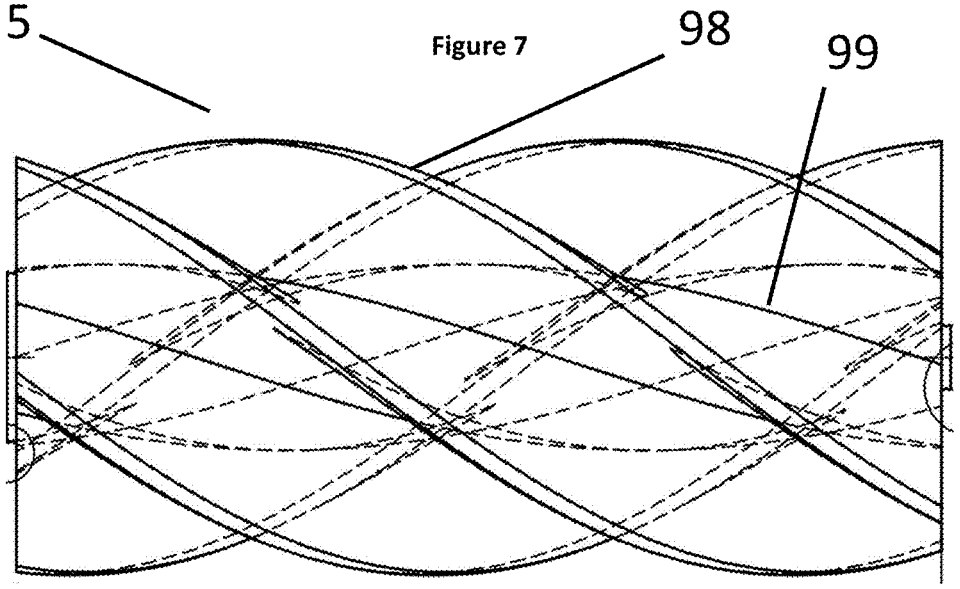
FIG. 7 is a hidden-line drawing of a side view of a preferred embodiment of the female or gate rotor of the invention.

FIG. 7 is a hidden-line drawing of a side view of a preferred embodiment of the gate or female rotor 5 of the invention. The drawing shows a leading edge 98 and a groove 99 in a left-handed-thread.

It should be clear from the description and the detailed description of the drawings herein that the main or male rotor and gate or female rotor must be established in a fashion by which they will work together. Because the rotors operate in different directions, the handedness of the threads of each of the rotors must be opposite in a two-rotor invention. In addition, the number and shaping of the lobes must be designed to work together.

Figure 8:
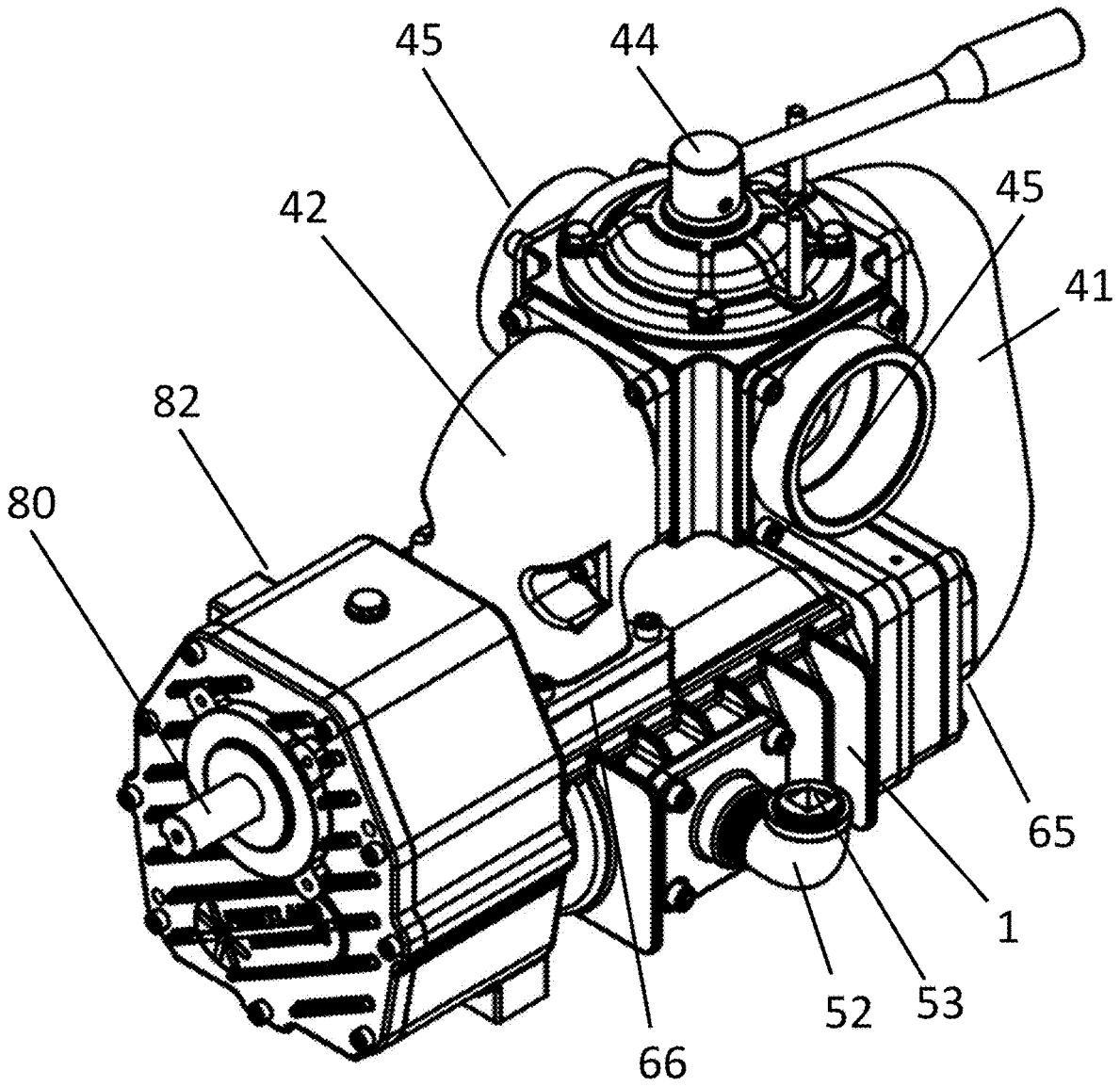
FIG. 8 is a detailed view of a preferred embodiment of the assembled invention.

FIG. 8 shows a detailed view of a preferred embodiment of the invention. Rotational force is applied to the shaft 80 and translated through the gearbox 82 to the rotors which are not seen in the drawing. A four-way diverter valve 44 allows connection of vacuum and compressed air at two different points 45 on the valve. The diverter valve 44 is in turn connected to the air inlet 65 of the casing 1 through the intake elbow 41. Atmospheric air for cooling is applied to the air injection port through the air injection elbow 52 after the air injection port plug 53 is removed. The outlet port 66 is connected to the diverter valve 44 through the exhaust elbow 42.

In operation, the invention produces both a vacuum at the air inlet 65 and compressed air at the outlet port 66. The use of the elbows 41 and 42 and the four-way diverter valve 44 allows for the use of both vacuum and compression at the same time and in a controllable fashion through the two ports 45. The four-way diverter valve 44 allows the ports 45 to be switched between vacuum and compressor operation. Additional piping connected to the ports 45 would be used in practice to apply the vacuum and compression as required.

Although the preferred embodiment of the invention is shown in a vertical or upright position in the drawing, because the air injection elbow 52 is located on one side of the invention, the invention can also be mounted on the side opposite to the air injection elbow 52 in a horizontal configuration.

Figure 9:
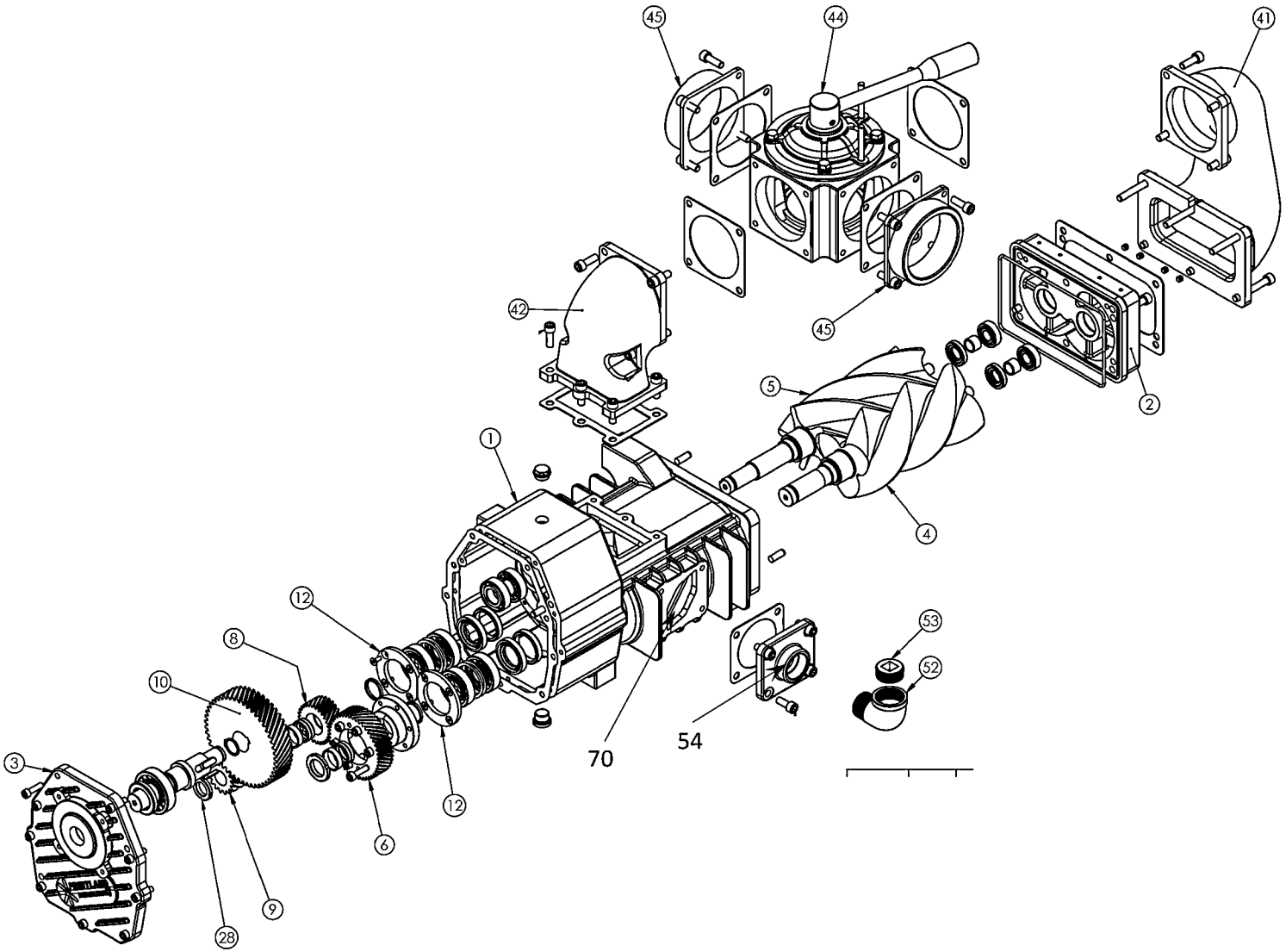
FIG. 9 is an exploded view of all of the parts of a preferred embodiment of the invention.

FIG. 9 shows an exploded view of the parts of a preferred embodiment of the invention. The rotors 4 and 5 are mounted in the casing 1 using appropriate mounting hardware. The hardware allows gear 6 attached to the main or male rotor 4 and gear 8 attached to the gate or female rotor 5 to, in turn, be driven by gear 10. Gear 10 is extended outside of the housing gearbox cover 3 in order to be connected to external motive force. The air injection port 70 is covered with appropriate hardware 54 which allows the introduction of air at atmospheric pressure and temperature through the air injection elbow 52 when the air injection port plug 53 is removed. The hardware 54 and air injection elbow 52 prevent any interference or interaction with the main or male rotor 4 rotating adjacent to the air injection port 70. The air inlet port 2 and air outlet port are connected to elbows 41 and 42 respectively to the four-way valve 44. The use of the elbows 41 and 42 also prevent any interference or interaction with the rotors while in operation. Depending on the setting of the four-way valve 44, compressed air or vacuum is available at the two ports 45.

FIG. 10 shows simulation results of the invention with the air injection port 70 closed. As can be noted in the results, output gas temperature are in the range of 574 to 668 degrees Celsius. Output temperatures in this range would require special handling in operational situations with personnel in the near vicinity of the device.

FIG. 11 shows simulation results of the invention with the air injection port 70 open. Operational output air temperatures are between 200 and 210 degrees Celsius. Such temperatures can be handled easily in operational situations with personnel in the near vicinity of the device.

The present application discloses a rotary screw vacuum pump having the ability to operate at a lower outlet air temperature. The invention disclosed reduces maintenance costs by reducing the size of the pump, that the pump may be operated without lubrication and in a mode that allows both vacuum and compressed air to be provided at the same time.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent.

Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention. While the disclosure has been illustrated and described in detail in the drawings and foregoing description, such illustration and description are to be considered illustrative or exemplary and not restrictive.

All references cited are incorporated herein by reference in their entireties. To the extent publications and patents or patent applications incorporated by reference contradict the disclosure contained in the specification, the specification is intended to supersede and take precedence over any such contradictory material.

Although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

The invention claimed is:

1. A rotary screw vacuum pump comprising:

two or more rotors having meshed helical formations and being supported for rotation in respective bores inside a casing, wherein the operation of the said rotors introduces, compresses and discharges gas from the rotary screw vacuum pump, and the said rotors are driven by an external motive force;

wherein the casing comprises:

a gas inlet port for admitting gas to the casing;

a gas outlet port for discharging gas from the casing; and at least one gas injection port located in a wall of the casing for the introduction of the gas at atmospheric pressure at an intermediate point between the gas inlet port and the gas outlet port, wherein the gas injection port is a single diagonal channel the direction of which is the same as the diagonal direction of the rotor adjacent to the said gas injection port.

2. The rotary screw vacuum pump of claim 1 wherein there are two rotors and one of the said rotors of which is a male rotor and the other of which is a female rotor.

3. The rotary screw vacuum pump of one of claims 1-2 wherein one of the rotors is driven directly by the external motive force and the remaining rotors are driven through gears connected to the external motive force.

4. The rotary screw vacuum pump of one of claims 1-2 wherein all of the rotors are driven through gears connected to the external motive force.

5. The rotary screw vacuum pump of claim 2 wherein the male rotor is driven directly by the external motive force and the female rotor is driven through gears connected to the external motive force.

6. The rotary screw vacuum pump of claim 2 wherein the female rotor is driven directly by the external motive force and the male rotor is driven through gears connected to the external motive force.

7. The rotary screw vacuum pump of claim 2 wherein the male rotor and the female rotor are both driven through gears connected to the external motive force.

8. The rotary screw vacuum pump of any of the preceding claims wherein the gas inlet port and the gas outlet port are connected through suitable ducting to a valve to provide for control of the vacuum and the gas being compressed and discharged.

9. The rotary screw vacuum pump of any of the preceding claims wherein the gas is air.

10. The rotary screw vacuum pump of any of claims 2 or 3-9 wherein the male rotor has three lobes and the female rotor has five lobes.

11. The rotary screw vacuum pump of any of claims 2 or 3-9 wherein the male rotor and the female rotor have meshed helical profiles.

12. A rotary screw vacuum pump for mobile operation comprising:

a male rotor of three (3) lobes and a female rotor of five (5) lobes having meshed helical formation;

the male rotor and the female rotor being supported for rotation in respective bores inside a casing, wherein the operation of the male rotor and female rotor are driven by an external motive force through gears which introduces, compresses and discharges air from the invention;

wherein the casing comprises:

an air inlet port for admitting air to the casing;

an air outlet port for discharging air from the casing; and an air injection port located in a wall of the casing for the introduction of the air at an intermediate point between the air inlet port and the air outlet port, wherein the said air injection port is a single diagonal channel the direction of which is the same as the diagonal direction of the rotor adjacent to the said air injection port.

* * * * *